United States Patent [19]

Schier

[11] 4,058,455

[45] Nov. 15, 1977

[54] ROTARY SEPARATOR

[75] Inventor: Josef Schier, Bergkamen-Oberaden, Germany

[73] Assignee: Ruhrkohle AG, Essen, Germany

[21] Appl. No.: 658,602

[22] Filed: Feb. 17, 1976

[30] Foreign Application Priority Data

Feb. 19, 1975 Germany ..... 2507145

[51] Int. Cl.[2] ..... B07B 7/10

[52] U.S. Cl. ..... 209/139 R; 55/300

[58] Field of Search ..... 209/139 R, 139 A, 150, 209/138; 55/304, 430, 300, 305; 222/203

[56] References Cited

U.S. PATENT DOCUMENTS

| | | | |
|---|---|---|---|
| 609,537 | 8/1898 | Emerick | 209/139 A |
| 1,876,516 | 9/1932 | Fraser | 209/139 A |
| 2,211,274 | 8/1940 | Kuck | 209/139 A |
| 2,381,802 | 8/1945 | Booth et al. | 222/203 X |

*Primary Examiner*—Frank W. Lutter

*Assistant Examiner*—Ralph J. Hill

*Attorney, Agent, or Firm*—Michael J. Striker

[57] ABSTRACT

A rotary separator has a generally closed housing whose upper portion is formed with a row of throughgoing windows. A lining of flexible sheet material is secured in the housing over the windows. A fan in the upper portion of the housing circulates air in the housing up through an annular sleeve centered in the housing, down around the sleeve in an annular passage, and then up through the sleeve again. Below the lower end of the sleeve is provided an upwardly open discharge funnel. Particulate material to be graded is introduced into the upper portion of the housing with the fan rotating so that the heavy fraction falls down into the funnel and the light fraction is entrained upwardly outside the funnel. A device is provided for inwardly deflecting the lining and knocking off it caked-on material so as to prevent this material from building up and blocking the outer annular flow passage.

9 Claims, 2 Drawing Figures

ROTARY SEPARATOR

BACKGROUND OF THE INVENTION

The present invention relates to a rotary separator. More particularly, this invention concerns an apparatus used for separating light and heavy fractions of particulate material.

A separator is known having an upright generally cylindrical housing in the upper portion of which is provided a centered cylindrical sleeve spaced above a frustoconical funnel. The lower end of the funnel is formed as a heavy-fraction outlet and the annular space between the outside of the funnel and the housing is provided with light-fraction outlets. The particulate material is introduced into the upper portion of the housing through a vertically extending tube and falls onto an impingement or distributing plate which axially blocks the end of the inlet tube. Above the sleeve there is provided a fan rotatable about a vertical axis to circulate air or another gas within the housing in a closed path that rises through the sleeve and descends in the annular passage surrounding the sleeve.

When ungraded particulate material is introduced the filler tube into the upper compartment it is first deflected outwardly into the rising air stream in the sleeve. The heavy fraction falls down in the sleeve into the funnel and can be removed. The light fraction is, however, entrained by the rising air and passed up and over the upper edge of the sleeve so as to fall down into the annular space between the funnel and the compartment.

A difficulty with such a separator, particularly when used to separate fines from coal, is that the light fraction adheres and cakes to the inside of the housing, particularly in the upper portion of this housing. In the grading of coal these fines are frequently rather moist so that they can form a rock-hard crust inside the separator. As this crust builds up it reduces the flow cross-section of the annular passage surrounding the sleeve so as to reduce the efficiency of the separator progressively. Eventually this passage will be blocked off altogether and the separator will not function at all.

Thus it is common practice with such a device to shut it down periodically, remove the top of the housing, and scrape off the caked-on lighter fraction. This is an onerous and time-consuming operation. Furthermore, the down-time implicit in such a cleaning operation will reduce the plant efficiency.

I have considered the idea of hanging from the upper wall of the housing a skirt of flexible material spaced slightly inwardly from the housing. Such an arrangement lessens the build-up of light particulate material, as the circulating air keeps the skirt in motion, so that caking-up is unlikely. The disadvantage of this system is that eventually the particulate material cakes to the wall of the housing behind the skirt, eventually completely filling the space between the skirt and the housing and making the skirt completely rigid. Once this occurs the caking-up then continues as in the prior-art arrangements.

SUMMARY OF THE INVENTION

It is therefore an object of the present invention to provide an improved rotary separator.

Another object is the provision of such a separator wherein such build-up of a dust layer inside the housing is largely eliminated.

Yet another object is to provide such a rotary scrubber which need not be shut down and taken apart for cleaning.

These objects are obtained according to the invention in a rotary separator of the above-described general type wherein the housing is formed in its upper portion with a row of throughgoing windows. Overlying these windows on the inside of the housing is a lining of a flexible sheet material which completely covers the windows and blocks substantially all air flow through them. Means is provided for inwardly deflecting this lining by engagement with the inner lining from outside the housing through the windows so that any caked-up dust inside the housing is loosened and will fall down in the light-fraction space therein.

In accordance with this invention the sheet material is elastomeric and the lining is formed of a plurality of sheets each covering at least two of the windows. Relatively stiff strips are secured over the edges of the sheets in the housing to prevent leakage around them and secure them tightly in place.

According to yet another feature of this invention, the housing is provided below the windows with a circumferential rail on which can run a carriage supporting a striking element engageable against the lining through the windows. This striking element has its own drive motor so that it can be reciprocated back and forth against the windows to vibrate them and knock off them any caked-up particulate material. It is also possible in accordance with this invention for the operator simply to walk around it periodically and strike the lining through the windows, deflecting it inwardly, with a simple hand tool.

Thus with the system according to the invention the separator need not even be turned off for the caked-up particulate material to be cleaned off its interior. It is possible to keep the build-up very thin so that the separator can operate with maximum efficiency.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
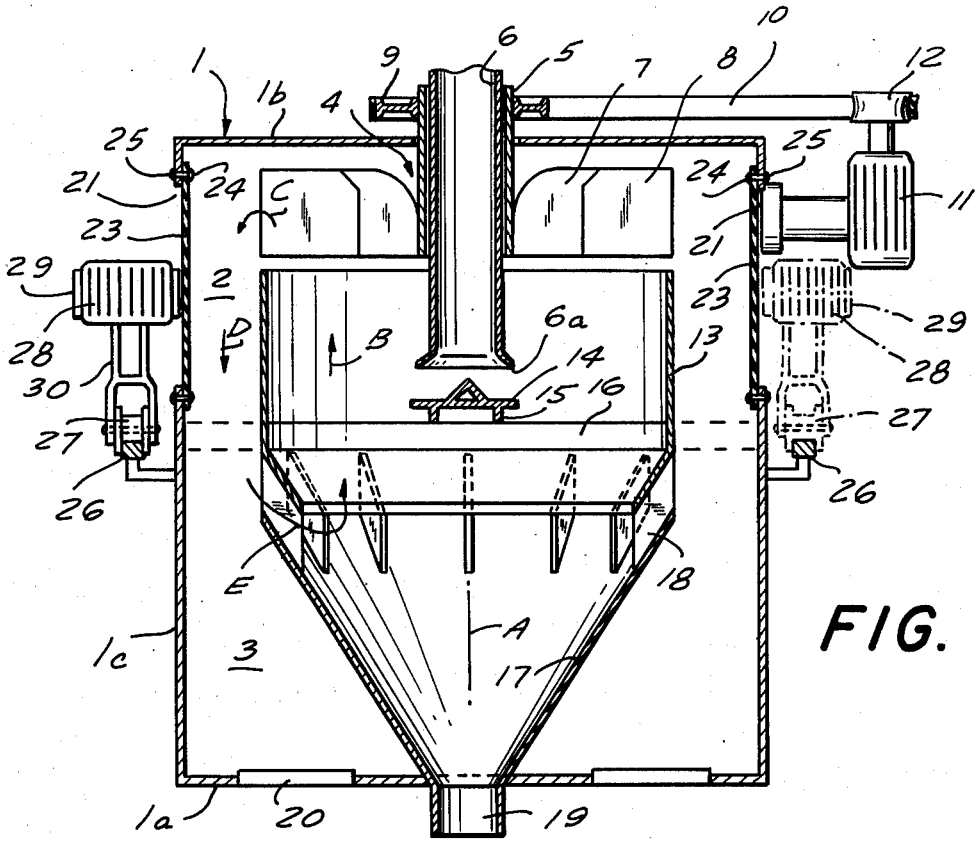
FIG. 1 is a vertical section through the separator according to the invention.
Figure 2:
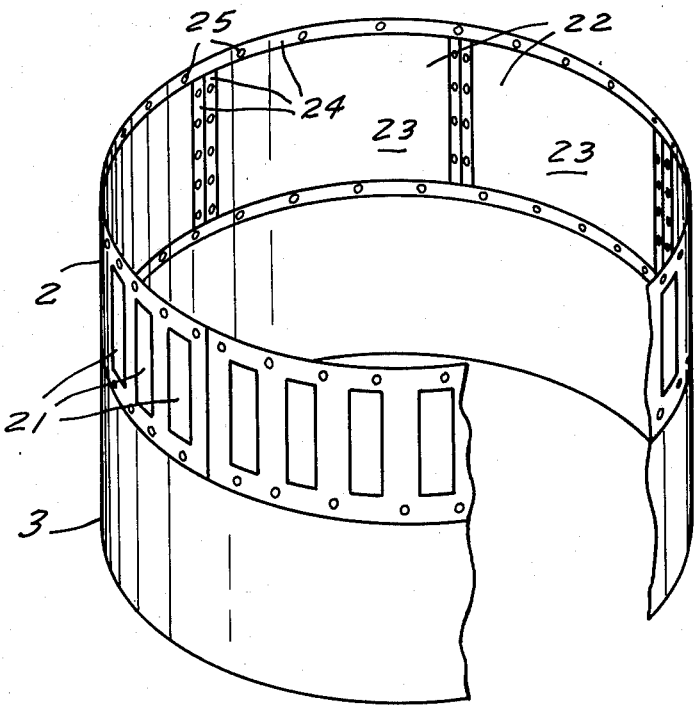
FIG. 2 is a perspective view partly broken away of the housing of the separator of FIG. 1.

A separator according to the present invention has as shown in FIGS. 1 and 2 a housing 1 of cylindrical shape centered on an axis A and having a bottom wall 1*a*, a top wall 1*b*, and a cylindrical side wall 1*c*. The interior of the housing is subdivided into an upper compartment 2 and a lower compartment 3.

A fan assembly 4 is provided in the upper compartment 2 and comprises a tubular drive shaft 5 carrying fan 7 having blades 8 tilted so as to draw air upwardly in the housing. A motor 11 mounted outside the housing carries a drive pulley 12 connected to a drive pulley 9 on the shaft 5 by a flat belt 10 to rotate the fan assembly 4 about the axis A.

Centered on the axis A is an upright loading tube 6 having an outwardly flared lower end 6a spaced above a deflector plate 14 carried on a cross member 15 secured on beam 16 within the housing.

Surrounding the lower end of the filler tube 6 is a cylindrical sleeve 13 having a frustoconically inwardly tapered lower end spaced above a concentric funnel 17 secured by means of vertical plates 18 to the sleeve 13. The lower end of the funnel 17 is formed as a heavy-fraction outlet 19 and the floor 1a of the housing 1 similarly is provided with light-fraction outlets 20.

In addition the housing side wall 1c is formed at the upper compartment 2 with a row of like rectangular windows 21. Inside the housing a lining 22 formed of rectangular sheets 23 of heavy elastomeric material cover these windows. Edge strips 24 and screws 25 secure these sheets 23 in place, each sheet here covering at least three windows 21. It is possible to provide a separate sheet 23 for each window.

Surrounding the housing below the windows 21 is a circular rail 26 on which can ride rollers 27 of a carriage 30 carrying a reciprocal piston 29 operable by a motor 28 for displacement radially relative to the axis A.

The arrangement described above operates as follows:

The motor 11 rotates the fan 4 in such a direction that air is drawn upwardly in the housing in the direction indicated by arrow B, over the upper edge of the housing as indicated by arrow C, downwardly in the passage between the sleeve 13 and housing wall 1c as indicated by arrow D and then back into the interior of the sleeve 3 by passing between the upper end of the funnel 17 and the lower end of the sleeve 13 as indicated by arrow E. Thus this air circulates in a closed path, therefore forming an involuting toroid.

Particulate material introduced into the tube 4 will fall down therein onto the distributing plate 14 and be deflected thereby outwardly into the rising stream indicated by arrow B. The heavier fraction will fall in the funnel 17 and be recoverable from the outlet 19. Lighter fraction, however, will be entrained upwardly by the air and follow its path. As the light fraction descends in the direction of arrow D, however, it will inertially continue to fall, passing out of the current of air and dropping onto the floor 1a of the housing 1 outside the funnel 17 so that it can be recovered through the outlets 20. It is noted that the inlet tube 4 and outlets 19 and 20 are provided with gas locks to prevent leakage of the system.

After some use of the apparatus some of the particles of the light fraction will adhere to and cake up, particularly in the area of the lining 23 where they are thrown inertially outwardly by the fan 4. In order to prevent this caked-on dust from building up too thick a layer the motor 28 is operated and the carriage 30 moved around the rail 26. This causes the element 29 to strike through the windows 21 against the outside of the lining sheets 23 and loosen the caked-on material. When loosened this material then falls down inside the housing 1a for recovery through the outlet 20.

It is possible for the operator of the machine very easily to ascertain just how thick the caked-up layer is inside the lining 23. This is done by merely by pressing with the hand against the outside of this lining 23 to ascertain how thick it is. It is noted that if a little of the caked-on material does remain, it will not greatly interfere with the operation of the separator and, indeed, even serves as a protective coating for the interior of the elastomeric sheets 23.

It will be understood that each of the elements described above, or two or more together, may also find a useful application in other types of devices differing from the types described above.

While the invention has been illustrated and described as embodied in a rotary separator, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features, that from the standpoint of prior art, fairly constitute essential characteristics of the generic or specific aspects of this invention.

What is claimed as new and desired to be protected by Letters Patent is set forth in the appended claims:

1. A rotary separator comprising:

a generally closed housing defining a separation chamber having an upper compartment and a lower compartment, said housing being formed around said upper compartment with a plurality of throughgoing windows;

a lining of flexible sheet material secured in said housing over said windows and substantially blocking gas flow into said compartments through said windows, said lining substantially completely laterally covering said housing in said upper compartment and having an inner surface directly exposed in said upper compartment;

a fan in said upper compartment;

an annular sleeve in said upper compartment below said fan and defining with said inner surface at said windows an annular passage;

a discharge funnel in said lower compartment said below said sleeve and defining with said housing an annular space open to said passage;

means for introducing into said upper compartment below said fan and inside said sleeve particulate material having a heavy fraction and a light fraction;

means for rotating said fan and circulating air in said chamber in a closed path rising inside said sleeve and descending in said passage, whereby said heavy fraction drops countercurrent to the rising air in said sleeve to land in said funnel and said light fraction is carried by said air over said sleeve and deposits in said space with some of said light fractions adhering to said inner surface; and means including a striking element displaceable relative to said housing and engageable through said windows with said lining for inwardly deflecting said lining relative to said housing by engagement with said lining through said windows for flexing said lining and loosening particulate material caked on said inner surface of said lining.

2. The separator defined in claim 1, further comprising a distributor plate in said upper compartment below said means for introducing and positioned to receive said particulate material as it is introduced.

3. The separator defined in claim 1 wherein said sheet material is elastomeric.

4. The separator defined in claim 1 wherein said housing and said sleeve are generally cylindrical and concentric.

5. The separator defined in claim 1 wherein said means for deflecting includes a motor for displacing said element.

6. A rotary separator comprising: a generally closed housing defining a separation chamber having an upper compartment and a lower compartment, said housing being formed around said upper compartment with a plurality of throughgoing windows; a lining including a plurality of separate sheets of flexible sheet material secured in said housing with each sheet extending over at least two of said windows; a fan in said upper compartment; an annular sleeve in said upper compartment below said fan and defining with said housing at said windows an annular passage; a discharge funnel in said lower compartment spaced below said sleeve and defining with said housing an annular space open to said passage; means for introducing into said upper compartment below said fan and inside said sleeve particulate material having a heavy fraction and a light fraction; means for rotating said fan and circulating in said chamber in a closed path rising inside said sleeve and descending in said passage, whereby said heavy fraction drops countercurrent to the rising air in said sleeve to land in said funnel and said light fraction is carried by said air over said sleeve and deposits in said space; and means for inwardly deflecting said lining by engagement therewith through said windows for loosening particulate material caked on the interior of said lining.

7. The separator defined in claim 6, further comprising relatively stiff strips fastened to said housing over the edges of said sheets.

8. A rotary separator comprising: a generally closed housing defining a separation chamber having an upper compartment and a lower compartment, said housing being formed around said upper compartment with a plurality of throughgoing windows; a lining of flexible sheet material secured in said housing over said windows; a fan in said upper compartment; an annular sleeve in said upper compartment below said fan and defining with said housing at said windows an annular passage; a discharge funnel in said lower compartment spaced below said sleeve and defining with said housing an annular space open to said passage; means for introducing into said upper compartment below said fan and inside said sleeve particulate material having a heavy fraction and a light fraction; means for rotating said fan and circulating air in said chamber in a closed path rising inside said sleeve and descending in said passage, whereby said heavy fraction drops countercurrent to the rising air in said sleeve to land in said funnel and said light fraction is carried by said air over said sleeve and deposits in said space; and means for inwardly deflecting said lining by engagement therewith through said windows for loosening particulate material caked on the interior of said lining, said means for deflecting including a striking element outside said housing engageable through windows with said lining, a motor for displacing said element, an endless annular rail surrounding said housing below said windows, and a carriage ridable on said rail and carrying said motor and said element.

9. The separator defined in claim 8 wherein said element is a reciprocal piston.

* * * * *